United States Patent [19]

Noorily

[11] Patent Number: 4,820,193

[45] Date of Patent: Apr. 11, 1989

[54] PANEL MOUNTED ELECTRICAL CONNECTOR INCLUDING MEANS FOR PROVIDING AN INDICATION OF CORRECT CONDUCTOR TERMINATION

[75] Inventor: Peter Noorily, Bridgewater, N.J.

[73] Assignee: Thomas & Betts Corporation, Bridgewater, N.J.

[21] Appl. No.: 176,830

[22] Filed: Apr. 4, 1988

[51] Int. Cl.[4] ..... H01R 3/00

[52] U.S. Cl. ..... 439/488; 439/507; 439/491

[58] Field of Search ..... 439/488–491; 40/316; 128/696; 174/112

[56] References Cited

U.S. PATENT DOCUMENTS

| | | | |
|---|---|---|---|
| 3,510,964 | 5/1970 | Dahners et al. | 35/22 |
| 3,772,635 | 11/1973 | Frey et al. | 439/488 |
| 3,989,338 | 11/1976 | Gosser | 439/491 |
| 4,202,351 | 5/1980 | Biche | 128/696 |
| 4,449,778 | 5/1984 | Lane | 439/293 |
| 4,508,415 | 4/1985 | Bunnell | 439/497 |
| 4,512,622 | 4/1985 | Carney et al. | 439/488 |
| 4,521,969 | 1/1985 | Greenwood | 33/180 R |
| 4,636,024 | 1/1987 | Yahata | 439/488 |
| 4,704,091 | 11/1987 | Owens et al. | 439/281 |

FOREIGN PATENT DOCUMENTS

| | | | |
|---|---|---|---|
| 2034538 | 6/1980 | United Kingdom | 439/488 |

*Primary Examiner*—David Pirlot

*Attorney, Agent, or Firm*—Robert M. Rodrick; Salvatore J. Abbruzzese

[57] ABSTRACT

Electrical connector which provides visual recognition of the correct termination of plural discrete conductors is disclosed. The connector includes a base which supports plural electrical contacts therein. A conductor support assembly supports individually plural discrete conductors in a one-to-one correspondence with the contacts. The conductor support assembly includes thereon color indicative markings which correspond to the color-coded insulation of the conductors. A cover is supportable over the base which encloses the conductor support assembly to enclose the connection assembly. The cover includes plural apertures therethrough which align with the color indicative markings of the conductor support assembly to permit external visual access to the markings so that a comparison may be made between the markings and the color coding of the insulation.

16 Claims, 5 Drawing Sheets

PANEL MOUNTED ELECTRICAL CONNECTOR INCLUDING MEANS FOR PROVIDING AN INDICATION OF CORRECT CONDUCTOR TERMINATION

FIELD OF THE INVENTION

The present invention relates generally to electrical connectors of the type which terminate plural insulative electrical conductors. More particularly, the present invention relates to an electrical connector which terminates plural conductors in the connector and provides a visual indication of correct conductor termination.

BACKGROUND OF THE INVENTION

It is known to provide electrical connectors which terminate plural discrete electrical conductors in a connector housing. Connectors of this type may be used in data/communications equipment where it is necessary to connect one component to another. It is also been found useful to employ electrical connectors of the hermaphroditic type where the connector is capable of mating to another identical connector. An example of this type connector is shown and described in U.S. Pat. No. 4,682,836 issued July 28, 1987, and assigned to the assignee of the present invention.

Briefly, connectors of this type include an insulative housing supporting plural electrical contacts which individually electrically terminate one of the conductors of a multiconductor cable. Proper useage requires that each conductor of the multiconductor cable be properly terminated to the correct one of the contacts of the connector. Incorrect termination and subsequent connection to data/communications equipment would impede the function of the equipment and could cause damage to one or more of the components.

The uncertainty associated with incorrect termination is enhanced where the user does not terminate the multiconductor cable to the connector. Connectors, especially those known as panel mount connectors, where the connector housing is designed to be secured to an electrical panel having plural such connectors disposed thereon, increase the risk of incorrect connection as the conductors are often terminated in the housing at the factory. The user in most cases is relying on factory automation to assure proper conductor termination. In many instances, the user would not know of a factory defect until connection is made and the data/communications components are used. Obviously, at that point, it may be too late to rectify any problems which may have occurred due to incorrect termination of the conductors to the contacts in the housing.

It is desirable to provide an electrical connector, especially those designed for panel mounting, which would provide an instant visual indication of correct connection of the individual conductors to the contacts supported in the housing.

SUMMARY OF THE INVENTION

It is an object of the present invention to provide an electrical connector housing which provides visual recognition of correct termination of plural discrete conductors.

It is a further object of the present invention to provide an electrical connector having a connector block which supports individual conductors in position for termination to the contacts of the connector and which provides a visual indication of the correct alignment of the conductors with respect to the support block.

These and other objects of the present invention are provided in an electrical connector assembly comprising plural discrete insulated conductors where each of the conductors includes distinguishing markings on the insulation thereof. The assembly further includes a connector housing which accommodates plural electrical contacts therein. The contacts include a first end for individually terminating ends of the insulated conductors and a second end for making exterior electrical connection. The connector housing supports a conductor support block having individual support channels which support the ends of the conductors in side-by-side relation. The support block is retentively supported in the housing such that the ends of the conductors are placed in electrical connection with ends of the contacts. The support block further includes identifying indicia thereon adjacent each of the channels which support the conductors. The identifying indicia corresponds to distinguishing markings on the insulation of the conductors. A cover is supportable on the housing to enclose the contacts and the support block. The cover includes visual access means which permits the visual inspection of the identifying indicia on the support block to assure correspondence with the distinguishing markings on the conductors extending from the connector to thereby assure correct termination of the conductors to the contacts.

As described by way of a preferred embodiment herein, the present invention includes an insulative housing which provides for entry of plural electrical conductors. Each of the conductors has color-coded insulation therearound. Ends of the conductors are supported in a support block which is insertably accommodated in the housing in a manner such that the ends of the conductors are terminated to plural electrical contacts also supported by the housing. The support block includes plural channels which individually accommodate different ones of the conductors. Adjacent each channel are color-coded markings which correspond to the color coding of the insulation of the conductors. A cover is supportable over the support block to enclose the connector. The cover includes openings therethrough which permit visual access to the color-coded markings on the support block. Thus, proper orientation of the conductors with respect to the contacts may be assured by visually inspecting the correspondence between the color markings on the support block and the color-coded insulation of the conductors.

The preferred embodiment of the present invention further includes a metallic member surrounding the contacts. This metallic member shields the connector from electromagnetic interference and radio frequency interference. The support block of the present invention may also support conductive shorting elements which place pairs of the contacts of the housing in electrical continuity.

DETAILED DESCRIPTION OF THE PREFERRED EMBODIMENT

Figure 1:
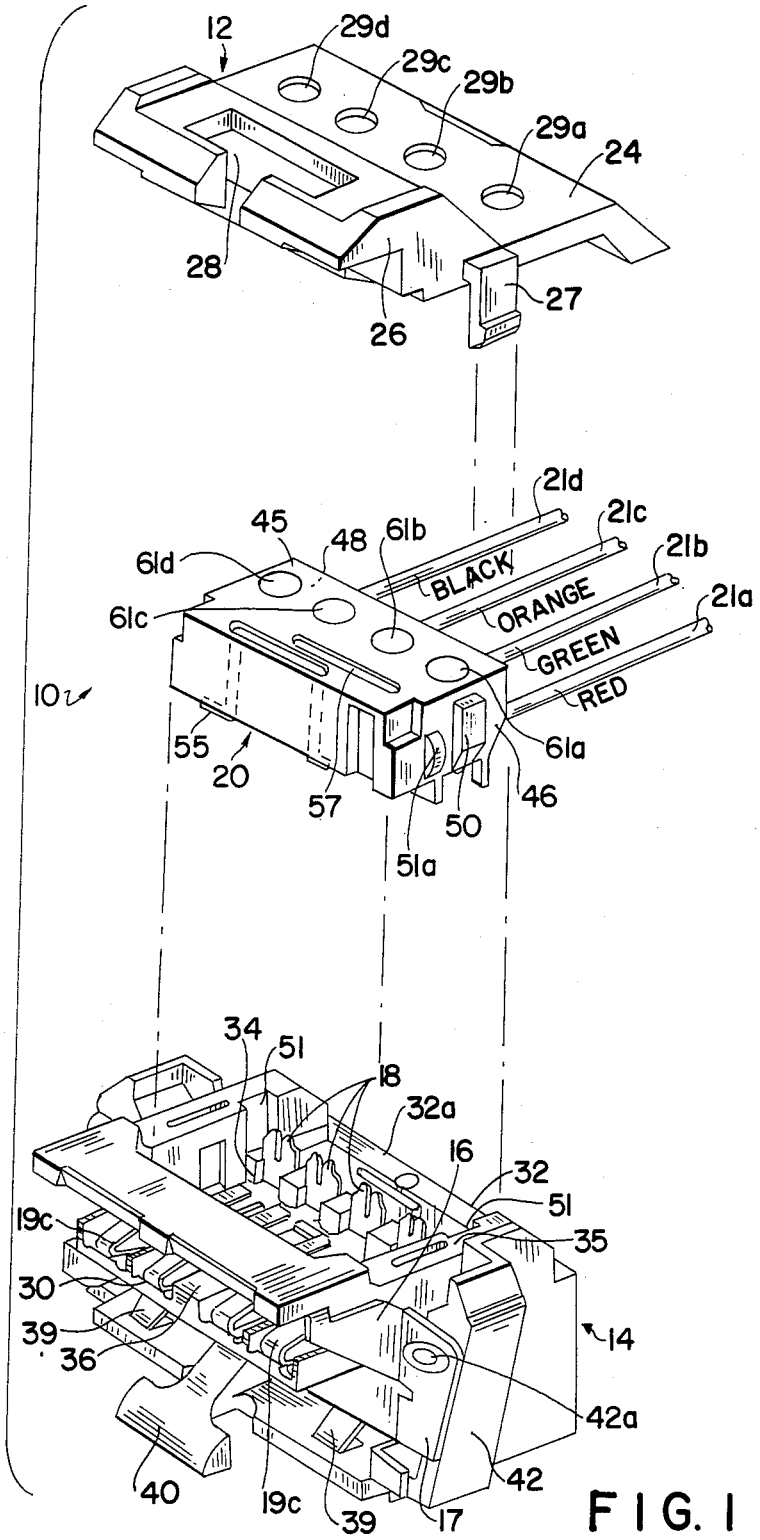
FIG. 1 shows an exploded perspective view of the electrical connector and assembly of the present invention including plural conductors supported in a support assembly.

Referring now to the drawings especially FIG. 1, an electrical connector 10 and assembly of the present invention is shown. Connector 10 is generally of the hermaphroditic type having male and female interlocking features where the connector may be electrically connected to another connector having substantially similar interlocking features. Connector 10 generally includes an insulative housing having a cover 12 and a base 14. An electrically conductive shield 16 is disposed on the base 14. A conductor support assembly 20 is shown terminating plural discrete conductors 21*a* through 21*d* (generally denoted as 21). Conductors 21 are conventional copper wire elements having insulative plastic therearound. In the present invention, conductors 21 include color-coded insulation therearound, where each conductor 21*a*–21*d* is uniquely identified by a different color. For illustrative purposes conductors 21*a*–21*d* are shown as having red, green, orange and black insulation respectively. Base 14 further supports plural electrical contacts 18 which are provided in one-to-one correspondence with the number of conductors 21. Electrical connector 10 is substantially similar to an electrical connector shown and described in U.S. Pat. No. 4,682,836 issued on July 28, 1987, and entitled "Electrical Connector and Cable Termination Apparatus Therefor" which is assigned to the assignee of the present invention.

Figure 2:
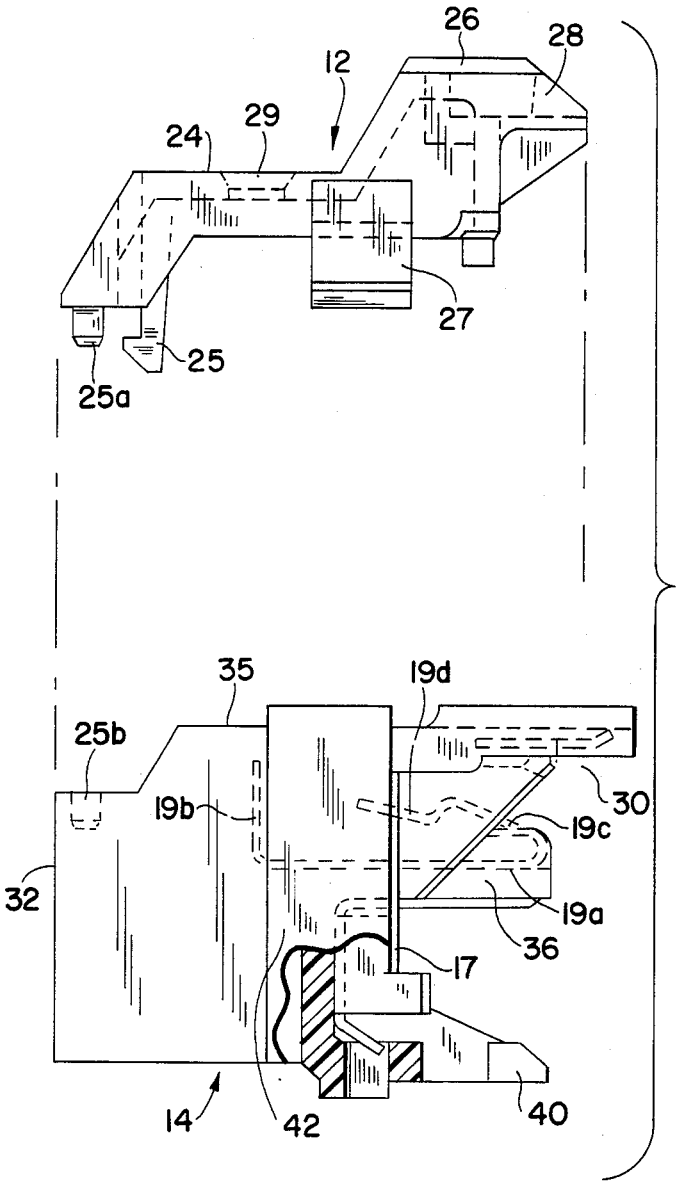
FIG. 2 is a side elevational showing of the electrical connector of FIG. 1.
Figure 3:
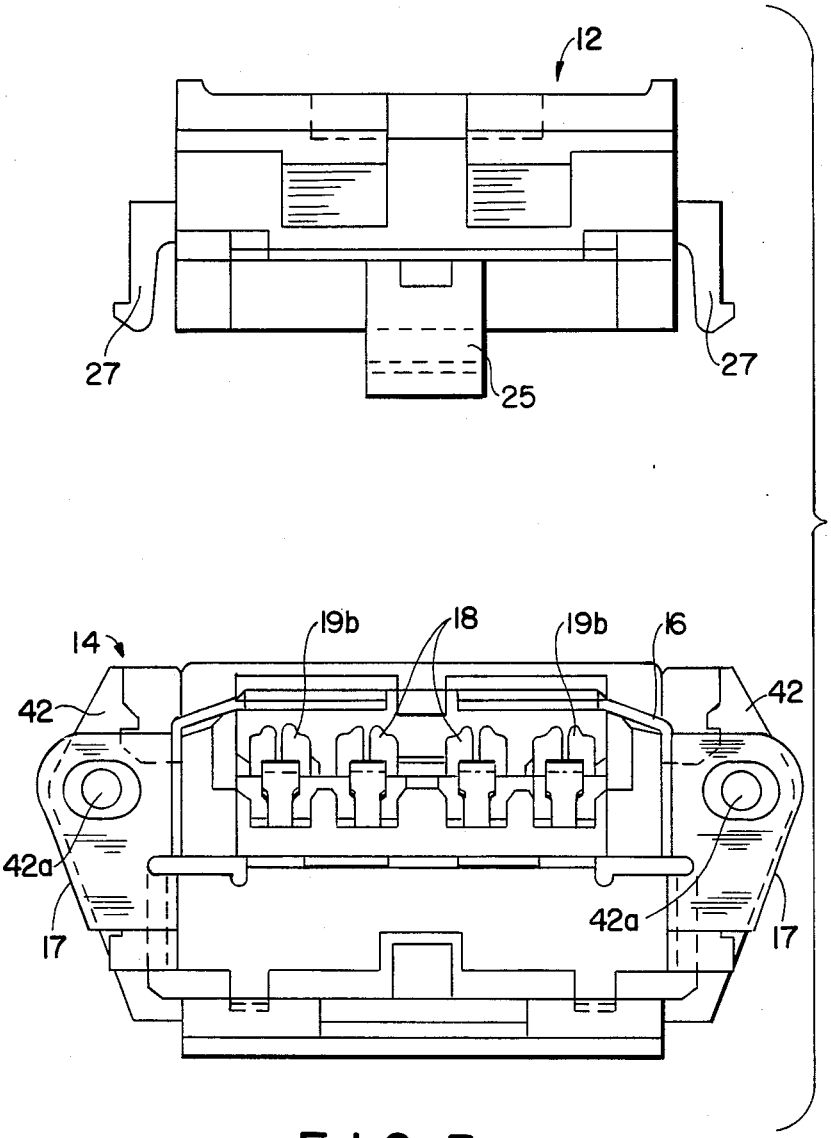
FIG. 3 is a front plan view of the electrical connector of FIG. 1 where the cover is shown raised above the connector housing.

Referring additionally to FIGS. 2 and 3, cover 12 includes an elongate generally planar first portion 24 and a stepped upper portion 26. Stepped upper portion 26 includes a centrally disposed recessed 28 which provides for removable locking interconnection of another hermaphroditic connector, especially that of the type shown in the above-identified U.S. Pat. No. 4,682,836 where the use and operation of such locking device is more fully described. Stepped upper portion 26 further includes a pair of spaced, depending latches 27 which are positioned to secure cover 12 to base 14. Planar portion 24 further includes a plurality of transversely spaced circular openings 29*a* through 29*d* (generally denoted as 29). The function of each of these openings 29 will be described in further detail hereinbelow. Planar portion 24 also includes a centrally located depending rear latch 25 (FIG. 2) which also helps to support and secure cover 12 to base 14. A post 25*a*, which is accommodated in hole 25*b* of base 14 also properly positions cover 12 with respect to base 14.

Base 14 is generally a rectangularly shaped member having a front face 30 for accommodating another hermaphroditic type electrical connector, a rear face 32 for permitting receipt of conductors 21 through a passage 32*a* and an open central section 34 for terminating conductors 21. Central section 34 opens to the upper surface 35 of base 14. A horizontal central ledge 36 extends from central section 34 toward the front face 30 of base 14. Horizontal ledge 36 provides support for the side-by-side disposition of electrical contacts 18 in base 14.

Contacts 18 are electrically conductive members formed of a suitable material such as a copper alloy. Each contact includes an elongate base portion 19*a*, an insulation displacement contact (IDC) portion 19*b*, a folded over tongue portion 19*c* and a flat portion 19*d* extending from folded over tongue 19*c*.

As shown in detail in FIG. 3, IDC portion 19*b* is of conventional flat, blade type construction which makes electrical contact with conductor 21 inserted between the tines thereof. Folded over tongue portion 19*c* is designed to make hermaphroditic electrical connection with similar contacts supported in another hermaphroditic connector.

Base 14 also includes a pair of oppositely extending mounting ears 42. As connector 10 is typically mounted to an electrical panel, ears 42 provide a mounting surface for screw mounting of connector 10 thereto. Centrally located screw appertures 42*a* are included for such purposes.

Base 14 further includes a conductive shield 16 positioned adjacent the front face 30 thereof. Shield 16 is formed preferrably from a flat stamping of metal and generally surrounds contacts 18. As is well known in the electrical connection art, shield 16 shields the contacts from radio frequency interferences (RFI) and electromagnetic interferences (EMI). A pair of lower lances 39 which extend from shield 16, secure the shield 16 to base 14. The lances 39 are embedded into the plastic material forming base 14. Shield 16 also includes a pair of outwardly extending shield ears 17 which are positioned adjacent mounting ears 42 of base 14. In many instances, the electrical panel (not shown) to which connector 10 is mounted is a metallic member. In this instance, shield ears 17 are placed in direct contact with the panel thereby placing the shield 16 and the panel at the same electrical potential (usually ground potential).

Base 14 further includes a centrally disposed locking element 40 which extends outwardly from the front face 30 thereof. Locking element 40 of one connector 10 is insertable, in locking fashion, into centrally disposed recess 28 of a similar hermaphroditic connector especially those of the type shown in the above-identified U.S. Pat. No. 4,682,836.

Figure 5:
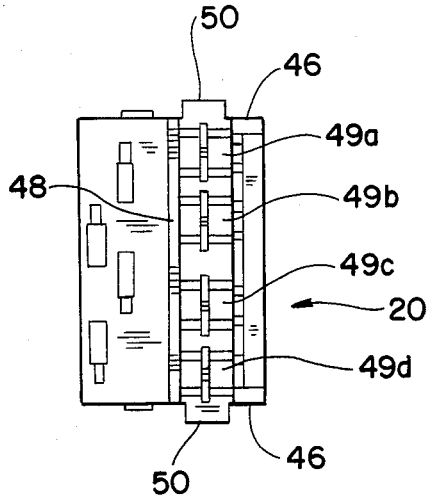
FIG. 5 is a bottom plan view of the support assembly shown in FIG. 1.

As shown particularly in FIGS. 1 and 5, conductors 21*a* through 21*d* are supported in spaced side-by-side fashion in conductor support assembly 20 for disposition over contact 18.

Support assembly 20 is an electrically insulative member preferrably formed of transparent molded plastic. Support assembly 20 includes an upper surface 45 and spaced, depending sidewalls 46. Upper surface 45 and depending walls 46 define an interior conductor accommodating region 48 shown more particularly in FIG. 5. A plurality of spaced, parallel support channels 49*a* through 49*d* (generally denoted as 49) are provided in the interior region 48 to accommodate in frictionally retaining fashion, the ends of conductors 21*a* through 21*d*. A pair of keys 50 are included on either side of support assembly 20 adjacent sidewalls 46 for insertion into corresponding key ways 51 on either side of base 14. A detent 51*a* on each sidewall 46 lockingly secures conductor support assembly in base 14. When properly positioned in base 14, side-by-side channels 49*a* through 49*d* will align with each of the IDC portions 19*b* of contacts 18 to place the ends of conductors 21*a* through 21*d* into insulation displacement connection with contacts 18.

As illustrated in FIG. 1, conductor support assembly 20 supports a pair of shorting bars 55 and 57 retentively therein. The shorting bars 55 and 57 are more fully described in the above-identified U.S. Pat. No. 4,682,836. Briefly, these shorting bars 55 and 57 serve to contact flat portions 19d of contacts 18 to electrically common certain ones of the contacts when connector 10 is an unmated position.

Figure 4:
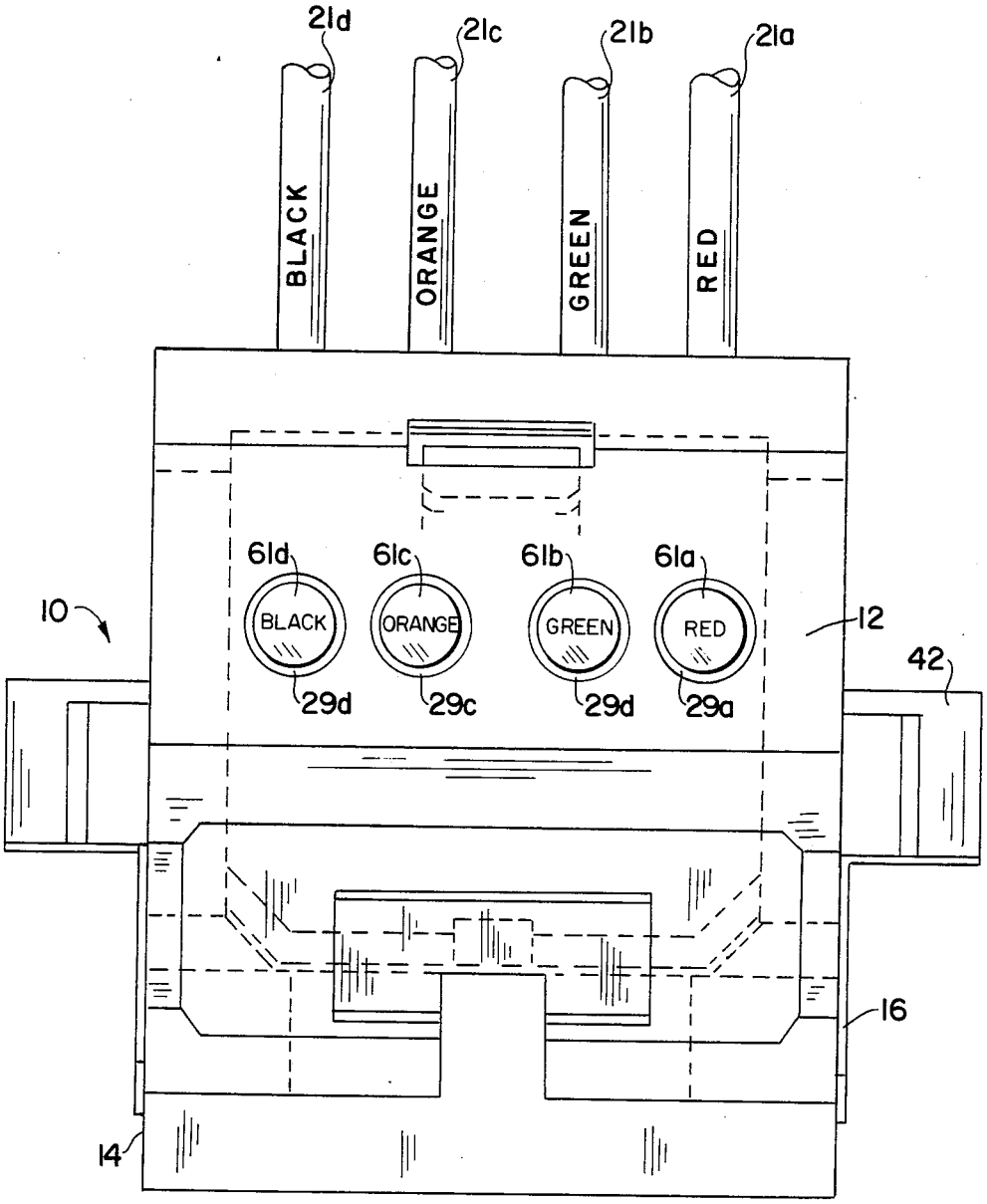
FIG. 4 is a top plan view of the assembled connector shown in FIG. 1.

Referring now to FIGS. 1 and 4, conductor support assembly 20 further includes a plurality of color indicative markings 61*a* through 61*d* (generally denoted as 61). Markings 61 are disposed on upper surface 45 of support assembly 20. Each of the markings 61*a* through 61*d* are respectively supported above adjacent conductor support channels 49*a* through 49*d*. Color indicative markings 61 correspond in direct relation to the color-coded insulation on conductors 21*a* through 21*d*. Thus, a visual indication of the correct positioning of conductors 21 in support channels 49 may be seen by comparing the appropriate color indicative markings 61 with the color-coded insulation of conductors 21.

FIG. 4 shows the assembled connector 10. Cover 12 is disposed over base 14 and encloses conductor support assembly 20. Color indicative markings 61 are aligned with cover openings 29 so that the color indication may be visually accessed through openings 29. It is readily apparent that a user employing connector 10, as shown in FIG. 4, can determine that the proper conductor 21 has been terminated with the proper electrical contact 18 by noting the correct alignment between color-coded insulation and the color indicative marking 61. Incorrect termination, such as by terminating green conductor 21*b* in conductor support channel 49*a* would be readily apparent as the green conductor 21*b* would be aligned with the red color indicative marking 61*a*.

It can be appreciated that other color combinations may be employed in a manner consistent with the present invention. Further, coding techniques other than color may be employed to provide proper identification.

Various changes to the foregoing described and shown structures would now be evident to those skilled in the art. Accordingly, the scope of the invention is set forth in the following claim.

I claim:

1. A conductor termination assembly comprising:

plural discrete insulated electrical conductors having distinguishing markings thereon;

an insulative termination housing having a first end accommodating said conductors and an open second end for cooperative electrical engagement with an electrical connector;

a plurality of electrical contacts supported in said housing each contact having an insulation displacing portion adjacent said first end of said housing and a terminal portion adjacent said second end of said housing;

an insulative conductor holding block including individual discrete support elements arranged in side-by-side relation each retentively supporting one of said plurality of said conductors, said holding block being supported in said housing to dispose said conductors in electrical engagement with said insulation displacing portions of said electrical contacts, said holding block further including identifying indicia adjacent each of said support elements, said identifying indicia corresponding to said distinguishing markings of said conductors; and a cover supported on said housing over said holding block, said cover including visual accessing means for permitting visual inspection of said identifying indica on said holding block to assure correspondence of each of said distinguishing markings of said conductors to said identifying indicia of said holding block.

2. A termination assembly of claim 1 wherein said distinguishing markings of said conductors include color coded insulation.

3. A termination assembly of claim 2 wherein said identifying indicia of said holding block includes color-coded marks corresponding to said color-coded insulation of said conductors.

4. A termination assembly of claim 3 wherein said visual accessing means includes said cover having a cover surface including at least one opening therethrough for providing visual access to said color-coded marks on said holding block.

5. A termination assembly of claim 3 wherein said visual accessing means includes said cover having a cover surface including plural discrete openings therethrough for provding individual visual access to said color-coded marks on said holding block.

6. A termination assembly of claim 3 further including an electrically conductive shield supported by said housing adjacent said second end thereof.

7. A termination assembly of claim 6 further including conductive shorting means for selectively electrically commoning two or more contacts of said plurality.

8. A termination assembly of claim 7 wherein said shorting means includes a pair of electrically conductive shorting elements.

9. In combination, a plurality of discrete electrical conductors, each conductor including color-coded insulation thereover thereby uniquely distinguishing one of said conductors from the others and an electrical connector which terminates ends of said discrete conductors, said connector further comprising:

a connector housing;

plural electrical contacts supported in said housing, each contact having a conductor termination end and an engagement end for making external electrical connection with another connector;

an electrically insulative conductor support block which is insertably accommodated in said housing adjacent said terminating ends of said contacts, said support block including plural side-by-side channels each of which individually supports one of said electrical conductors, said support block being insertable into said housing in a manner such that said conductors are placed in electrical connection with said terminating ends of said contacts, said support block further including plural color-coded markings adjacent each channel, each said color-coded marking corresponding in color to the color-coded insulation of the conductor inserted therein; and a cover adapted for disposition on said housing enclosing said conductor support block and said contacts, said cover including a visual access opening aligned with said color-coded markings on said support block to permit visual comparison between the color-coded insulation of said conductors and said color-coded markings.

10. A combination in accordance with claim 9 wherein said conductor support block includes an upper surface including said color-coded marking and an opposed lower surface including said side-by-side channels, said markings being in alignment with said channels.

11. A combination in accordance with claim 10 wherein said side-by-side channels are open ended to accommodate ends of said conductors.

12. A combination in accordance with claim 11 wherein said cover including said visual access opening includes plural apertures corresponding in number to said conductors, each of said apertures being in alignment with said markings to provide individual visual access to said markings.

13. A combination in accordance with claim 12 wherein said housing includes passage means to permit passage of said insulative conductors thereinto.

14. A combination in accordance with claim 13 wherein said passage means of said housing is adjacent said apertures of said cover to provide ease of comparison between said color-coded insulation and said color-coded markings.

15. A combination in accordance with claim 14 wherein said housing supports an electrical shield spaced from and substantially surrounding said contacts for shielding electromagnetic and radio frequency interferences.

16. A combination in accordance with claim 15 wherein said support block further supports in electrical isolation, a pair of conductive shorting elements, each of said elements for electrically commoning two or more of said contacts.

* * * * *